US006647914B1

(12) United States Patent
Gerhardinger et al.

(10) Patent No.: US 6,647,914 B1
(45) Date of Patent: Nov. 18, 2003

(54) FREE-STANDING MARINE WINDSHIELD ASSEMBLY HAVING A POLYMERIC FRAME

(75) Inventors: Peter F. Gerhardinger, Maumee, OH (US); Brett Jacobson, Brentwood, TN (US)

(73) Assignee: Engineered Glass Products, LLC, Chicago, IL (US)

( * ) Notice: Subject to any disclaimer, the term of this patent is extended or adjusted under 35 U.S.C. 154(b) by 36 days.

(21) Appl. No.: 10/024,695

(22) Filed: Dec. 18, 2001

(51) Int. Cl.[7] ..... B63B 17/00
(52) U.S. Cl. ..... 114/361
(58) Field of Search ..... 114/343, 364, 114/361

(56) References Cited

U.S. PATENT DOCUMENTS

| | | | | |
|---|---|---|---|---|
| 3,093,844 | A | * 6/1963 | Brock et al. | 114/361 |
| 3,372,016 | A | 3/1968 | Rahrig et al. | |
| 3,775,087 | A | 11/1973 | Ritter | |
| 3,810,267 | A | * 5/1974 | Fussell, Jr. et al. | 114/361 |
| 3,843,982 | A | 10/1974 | Lane et al. | |
| 3,951,634 | A | 4/1976 | Hall et al. | |
| 3,978,535 | A | 9/1976 | Swan et al. | |
| 3,996,035 | A | 12/1976 | McHenry | |
| 4,057,411 | A | 11/1977 | Reese | |
| 4,111,676 | A | 9/1978 | Mechling et al. | |
| 4,151,620 | A | 5/1979 | Heuzonter | |
| 4,240,816 | A | 12/1980 | McMaster et al. | |
| 4,441,909 | A | 4/1984 | McKelvery et al. | |
| 4,551,372 | A | 11/1985 | Kunert | |
| 4,750,449 | A | 6/1988 | Muhlberger | |
| 4,759,788 | A | 7/1988 | Ward | |
| 4,815,410 | A | 3/1989 | Muhlberger | |
| 4,838,195 | A | 6/1989 | Carter | |
| 4,895,244 | A | 1/1990 | Flaugher et al. | |
| 4,926,782 | A | 5/1990 | Lacy | |
| 4,963,413 | A | 10/1990 | Amano | |
| 5,082,736 | A | 1/1992 | Bravet et al. | |
| 5,092,262 | A | 3/1992 | Lacy | |
| 5,188,651 | A | 2/1993 | Csehi | |
| 5,203,277 | A | 4/1993 | Norman | |
| 5,325,807 | A | 7/1994 | Hidekura | |
| 5,413,748 | A | 5/1995 | Garza | |
| 5,439,849 | A | 8/1995 | McBride et al. | |
| 5,505,156 | A | 4/1996 | Briggs | |
| 5,601,050 | A | 2/1997 | Erskine et al. | |
| 5,664,519 | A | 9/1997 | Erskine | |
| 5,784,982 | A | 7/1998 | Erskine | |
| 5,918,613 | A | 7/1999 | Larson | |
| 5,947,052 | A | 9/1999 | Deising | |
| 6,006,490 | A | 12/1999 | Thibeault | |
| 6,045,891 | A | 4/2000 | Garza | |
| 6,471,774 | B1 | * 10/2002 | Krueger | 118/264 |

* cited by examiner

*Primary Examiner*—Ed Swinehart
(74) *Attorney, Agent, or Firm*—Marshall & Melhorn, LLC

(57) ABSTRACT

The invention is a free-standing, self-supporting windshield adapted to be secured to the hull of a marine vessel. The windshield has at least one sheet of substantially transparent material having a peripheral edge. A polymeric frame is molded around the peripheral edge of the transparent material. An adhesion promoting primer applied to the peripheral edge of the substantially transparent material assists the polymeric frame to adhere to the transparent material. A lower portion of the frame is adapted to conform with, and be sealingly affixed to, a surface of the hull of the vessel. A top portion of the frame is designed to absorb an impact for safety considerations and it may also function as a handrail.

42 Claims, 13 Drawing Sheets

FREE-STANDING MARINE WINDSHIELD ASSEMBLY HAVING A POLYMERIC FRAME

BACKGROUND OF THE INVENTION

The present invention relates to an improved windshield assembly for use on marine vessels. More specifically, the present invention relates to a free-standing, self-supporting assembly comprised of a substantially transparent windshield, the peripheral edge of which is surrounded by a molded polymeric frame. The assembly can be attached to a flat or a curved surface by molding the flexible polymeric material to conform with the curvature of the surface.

Windshields have long been used on all types of marine vessels to protect the operator and passengers from exposure to wind, water spray, and the like. As the styling of marine vessels, particularly recreational vessels, has evolved, more varied and complex shapes of windshields have become desirable. Particularly desirable, are highly curved windshields, which give the appearance of being made of a single piece of essentially transparent material, such as glass or plastic, having a continuous frame. Such windshields provide a clean, streamlined look.

To date, efforts to produce such a windshield have largely been directed to one or more pieces of glass or plastic, to which a metal frame, containing a gasket, has been attached. The metal frame is usually constructed from a plurality of extruded aluminum parts, which conform to the shape of the glass or plastic pieces. Such an assembly must still be attached to the hull of the marine vessel which, in many cases, is itself curved. While various methods have been proposed, given the limited flexibility of any metal, it is difficult to obtain satisfactory conformity of the already stressed metal frame to another curved surface, such as the hull of a vessel. Furthermore, even when the metal frame assembly is attached to the hull of a vessel, it may be difficult to obtain an aesthetically pleasing watertight seal between the assembly and the hull.

Lastly, the plurality of metal parts in the assembly may create many sharp edges. These sharp edges, in addition to the inherently hard nature of metal, can cause injury if, for example, the operator of the vessel or a passenger is thrown against the assembly due to rough water, or other causes.

Therefore, it would be advantageous to have a safe, free-standing, self-supporting assembly for a marine vessel, which has broad flexibility from a styling/aesthetic viewpoint, has physical flexibility to conform to the shape of the windshield and forms a watertight seal with the hull of the vessel.

SUMMARY OF THE INVENTION

The present invention is a free-standing, self-supporting windshield assembly having a flexible polymeric frame, which is affixed to the upper surface of the hull of a marine vessel. The polymeric frame is molded to the peripheral edge of at least one substantially transparent panel of glass or plastic. Molding a frame onto the panel has the advantage over the prior art of not requiring the expenditure of time and resources to curve and fasten an extruded metal frame around the glass or plastic using a formed rubber gasket as a cushion.

Furthermore, a substantially continuous framework around each panel adds strength to the inherent structural strength of the bent glass or plastic. This added strength allows the assembly to be self-supporting thereby allowing it to be mounted as a free-standing unit to the hull of the marine vessel, capable of withstanding the forces applied to it by wind and water when the vessel is in operation.

The lower portion of the flexible polymeric frame is capable of intimately conforming to the shape of the upper surface of the hull of the vessel, such that a watertight seal is formed when the polymeric frame is affixed to the upper surface of the hull.

The frame may be formed with openings for (1) mechanical fasteners, (2) the mechanical fasteners themselves, or (3) a combination of both, so that the individually framed components and the assembly can be attached to the hull. Alternatively, a groove may be located in the hull of the vessel, which frictionally receives the framed windshield. One or more locking cleats are located behind the framed windshield to lock it in the groove.

The individually framed pieces are located adjacent one another for form the windshield assembly. Mechanical fasteners may be used to fasten the framed pieces together. Alternatively, the individual frames may be formed with complimentary interlocking edge portions.

The windshield assembly of the present invention has many advantages over the prior art. The present invention enhances the appearance of the vessel as it allows the encapsulated windshield assembly to appear as an extension of the hull. The assembly's appearance as an extension of the hull is due to the flexibility inherent in the molding process and the frame materials themselves, the combination of which allows it to conform intimately with the shape of a wide variety of hulls. The assembly's ability to conform intimately with the hull allows the assembly to seal in a watertight fashion with the hull.

Color may be mixed with the polymeric material so that the material has a homogeneous color throughout. This has the advantage of effectively camouflaging dents, scuffs and scratches, which expose the interior of the material, from the observer. Alternatively, the exterior of the polymeric material may be painted.

The polymeric material, with or without paint integrally formed therewith or applied thereon, has the further advantage of being highly resistant to ultraviolet radiation and, hence, resistant to fading over time.

Another benefit of the polymeric frame described herein relates to personal safety. If, for example, a person in the marine vessel falls against, or is thrown against, the assembly surrounded by the polymeric frame, some portion of the impact will be absorbed by the flexibility of the polymeric material. Additionally, the chances of being cut by contacting the polymeric frame are reduced. The properties of flexibility and "softness", especially when compared to the inherent hardness and sharp edges of a metal frame are clearly superior in reducing the potential for personal injury.

BRIEF DESCRIPTION OF THE DRAWINGS

The above, as well as other advantages of the present invention, will become readily apparent to those skilled in the art from the following detailed description of the preferred embodiment when considered in light of the accompanying drawing, in which.

DETAILED DESCRIPTION OF THE PREFERRED EMBODIMENTS

It is to be understood that the specific structures and processes illustrated in the attached drawings and described in the following description are simply exemplary embodiments of the inventive concepts defined in the appended claims. Hence, specific dimensions and other physical characteristics relating to the embodiments disclosed herein should not be considered as limiting, unless the claims expressly state otherwise.

Figure 1:
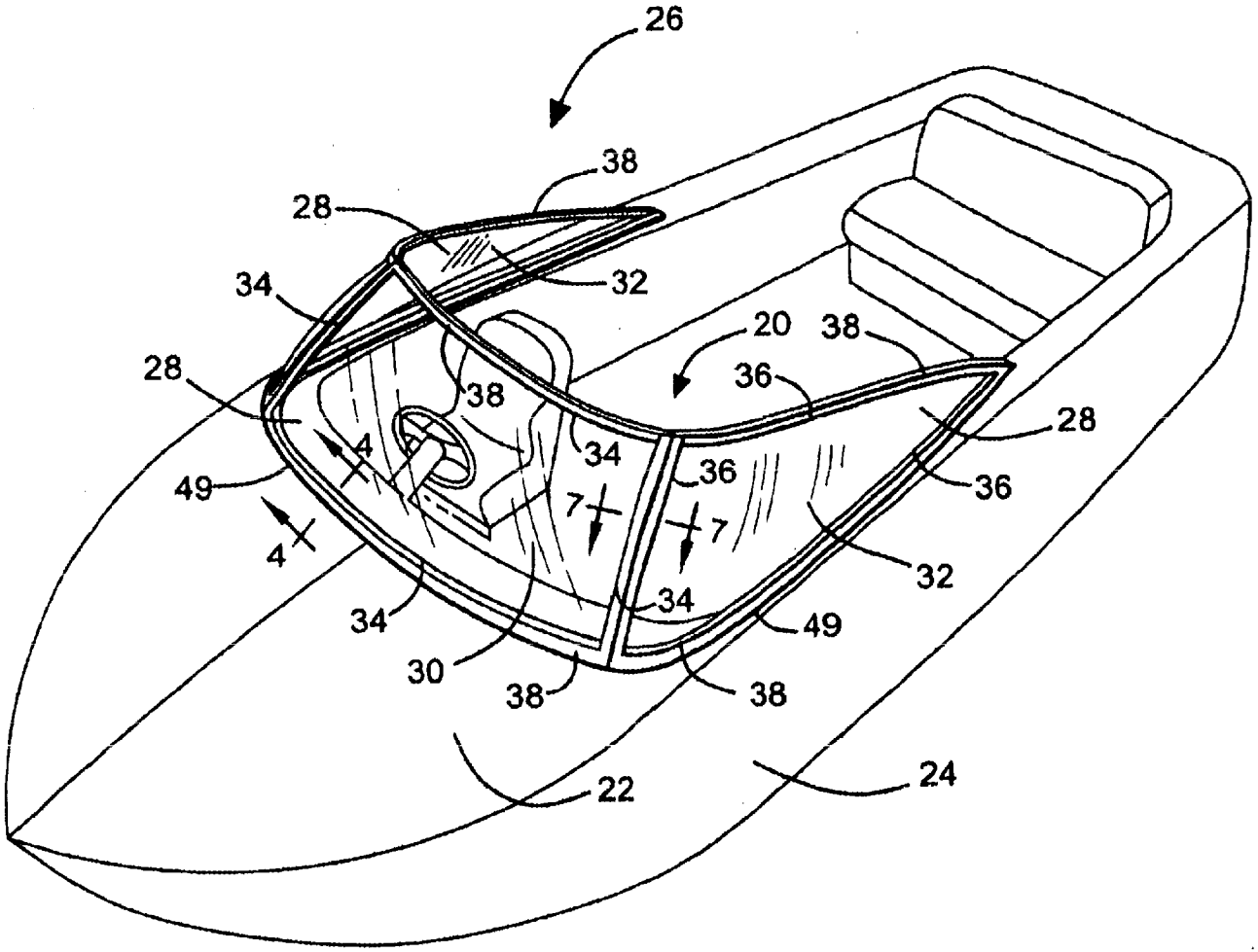
FIG. 1 is a perspective view of a construction embodying the present invention.

FIG. 1 depicts a marine windshield assembly 20 preferably located on the upper surface 22 of a hull 24 of a marine vessel 26. Preferably, the assembly 20 has one or more panels 28 of substantially transparent material. FIG. 1 depicts one embodiment of the present invention wherein the assembly 20 has a single forward facing panel 30 of substantially transparent material and at least two side facing panels 32 of substantially transparent material located adjacent the forward facing panel 30.

The panels 30, 32 are constructed substantially of a transparent material such as polycarbonate, although other materials known to those skilled in the art may be used. The materials are selected for their ability to withstand the potentially rigorous conditions which may be encountered by a marine vessel 26 during its operation on a body of water.

Another suitable material is glass, which may be utilized in multiple layers, each layer being adhered together by an essentially transparent interlayer material, such as polyvinyl butyral. When subjected to appropriate conditions of temperature and pressure, such multiple layers of glass and interlayer material form what are known as laminated structures.

For the present invention, however, it is more desirable to use a single sheet of glass or plastic material. If glass is used, preferably the glass is heat-strengthened, or most preferably tempered, as further described hereafter.

The glass sheet may be heat-strengthened in a conventional glass heat treating furnace (not shown) known to those skilled in the art by heating the glass sheet to within a specified temperature range for a specified residence time in the heating furnace. The glass sheet is then reduced in temperature at a controlled rate, thus creating a glass sheet with increased resistance to thermal breakage due to its increased surface compressive stress. Further heat strengthening of the glass, also known as tempering, maximizes the strength, as well as controls the pattern of breakage, thus minimizing, to the extent possible, the likelihood of injury upon impact.

For purposes of the present application, the term "heat-strengthened" shall mean a sheet of glass having a surface compressive stress of up to approximately 5,000 pounds per square inch (psi). "Tempered" shall mean a sheet of glass having a surface compressive strength greater than approximately 8,000 psi, and preferably greater than approximately 10,000 psi.

Various aspects of heat strengthening and tempering of glass are disclosed in, for example, U.S. Pat. Nos. 5,188,651; 4,895,244; 4,759,788; 4,441,909; 4,240,816; 4,111,676; 4,057,411; 3,996,035; 3,951,634; 3,775,087; and 3,372,016, which are incorporated herein by reference.

Preferably, the glass sheet will be heated in a conventional type-heating furnace to a temperature between 1202° F. and 1382° F. (approximately 650° C. to approximately 750° C.) with the specified residence time in the heating furnace being from approximately 100 to approximately 200 seconds.

The glass panels 30, 32 are preferably fabricated prior to such heat strengthening or tempering. By "fabricated" it is meant that from a glass sheet, usually having a rectangular shape, a panel 30 or 32 of the desired size and shape to form the windshield is cut by any conventional means, and the periphery of the glass is ground by any conventional means to remove sharp edges so that a person coming in contact with the edges would not be cut. The glass panel 30 or 32 may also be bent by conventional means, such as press bending or gravity bending, to a desired configuration for a particular marine vessel.

Figure 2:
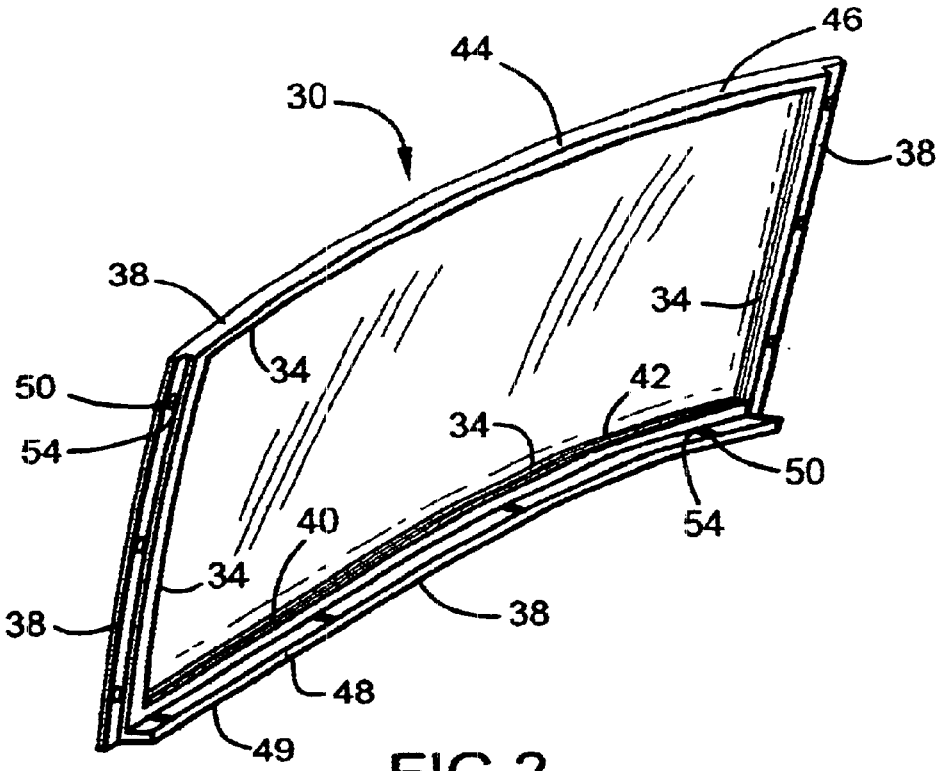
FIG. 2 is a component of the construction depicted in FIG. 1.
Figure 3:
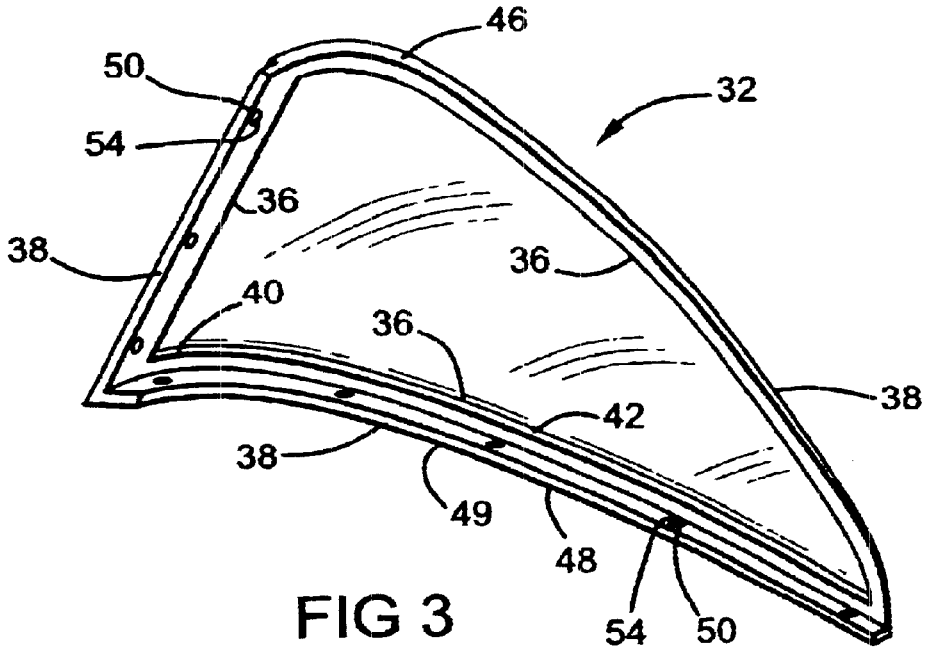
FIG. 3 is a additional component of the construction depicted in FIG. 1.

As shown in FIGS. 2 and 3, each panel 30, 32 has a peripheral edge 34 and 36, respectively. A continuous polymeric frame 38 is molded around each edge 34, 36 by any conventional means. Such means may include, for example, reaction injection molding (RIM), injection molding or extrusion (not shown). Various aspects of molding processes are disclosed in, for example, U.S. Pat. Nos. 6,045,891, 5,439,849, 5,413,748, 5,082,736, 4,963,413, and 4,551,372 and are incorporated herein by reference.

The material comprising the polymeric frame 38 may be, for example, a polyurethane, a polyvinyl chloride, or other suitable plastic materials known to those skilled in the art. As seen in FIGS. 2 and 3, at least a portion of the peripheral edge 34, 36 of the panels 30, 32, particularly if the material is glass, is treated with an adhesion-promoting primer material 40, preferably a silane primer. The molded polymeric frame 38 creates a seal 42 between itself 38 and the peripheral edge 34, 36 of the panel 30, 32 which is watertight.

As part of the frame molding process, the polymeric material located on a top edge 44 of each panel 30, 32 is formed as a radiused elbow 46 to absorb personal physical impacts without causing injury, as depicted in FIGS. 2 and 3. Furthermore, the top edge 44 may be created in any size, geometric configuration or texture so as to provide a handrail 45 for passengers in the vessel 26.

As an additional part of the frame molding process, the polymeric material located on a bottom edge 48 of each panel 30, 32 is formed to conform to the upper surface 22 of the hull 24. The formation of the polymeric material in the shape of the upper surface 22 of the hull 24 and the pliable nature of the polymeric material allows the polymeric frame 38 to intimately conform with the upper surface 22 of the hull 24. The intimate relationship of the polymeric frame 38 with the hull 24 assists in creating a watertight seal 49.

The molding process may also include providing openings 50 in the polymeric frame 38 to receive mechanical fasteners 52 for affixing the windshield assembly 20 to the hull 24 of a marine vessel 26, as depicted in FIGS. 2 and 3. Means to reinforce the provided openings 50, such as metal or plastic rings 54, may be incorporated into the frame 38 at the time of the molding process, as well. Other mechanical fasteners, such as snaps, hinges and the like, may also be molded into the polymeric frame 38 during the molding process.

Figure 4:
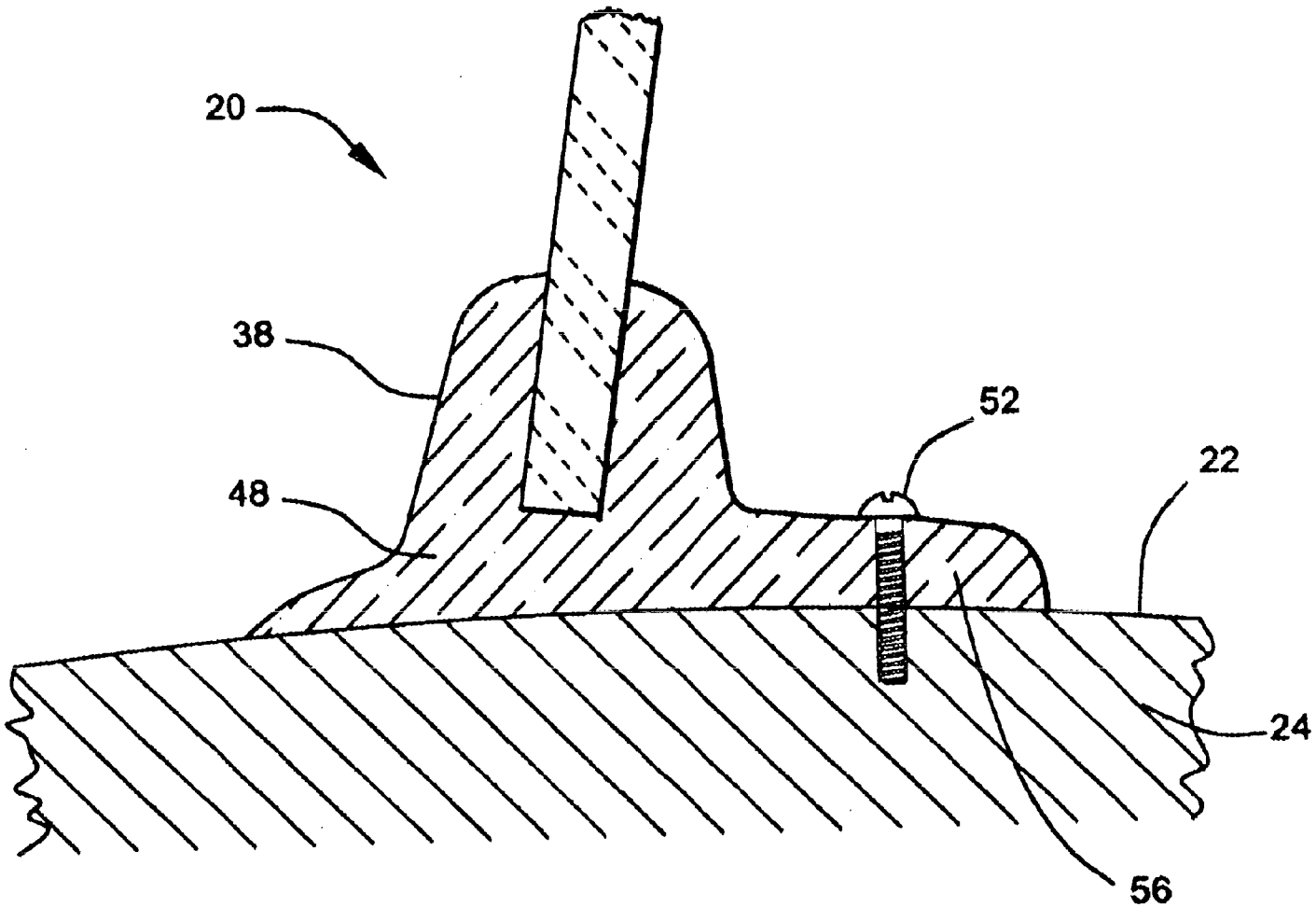
FIG. 4 is a fragmentary sectional view of the present invention, taken in the direction of the arrows along section line 4—4 of FIG. 1.

FIG. 4 depicts a mechanical fastener 52 located in a rear portion 56 of the bottom edge 48 of the polymeric frame 38. The rear portion 56 has been molded so as to have additional polymeric material for receiving one or more mechanical fasteners 52. Examples of mechanical fasteners 52 may include rivets, male and female couplings, clamps, bolts, nuts embedded in the material for receiving a complementary screw, or other similar devices known in the art. Embedding one or more nuts in the material 38 provides for a flush installation of the assembly 20 without visible fasteners. Although FIG. 4 depicts the rear portion 56 having additional polymeric material, such material may be located anywhere along the bottom edge 48 so as to adequately support the windshield assembly 20 in a free-standing, self-supporting orientation.

Figure 5:
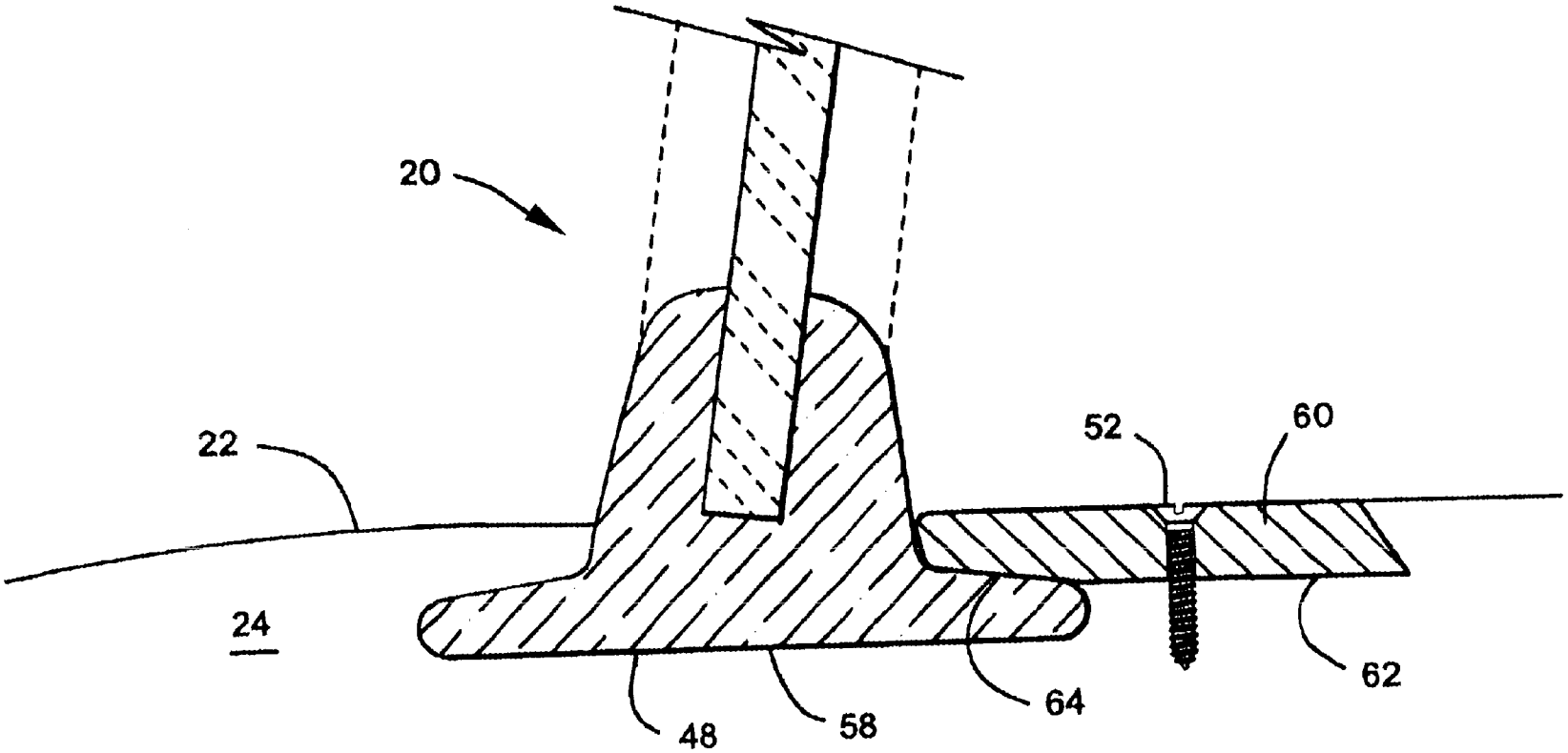
FIG. 5 is a fragmentary sectional view of an alternative embodiment of the present invention, taken in the direction of the arrows along section line 4—4 of FIG. 1.

In an alternative preferred embodiment, the bottom edge 48 may be located within a complimentary shaped first groove 58 located in the upper surface 22 of the hull 24, as depicted in FIG. 5. In this embodiment, the bottom edge 48 frictionally engages the first groove 58. Although a symmetrically shaped bottom edge 48 is depicted in FIG. 5, it is to be understood that bottom edges 48 having a variety of shapes and cross sections are within the scope and spirit of the present invention.

FIG. 5 also depicts a locking cleat 60 located within a second groove 62 in the hull 24. The second groove 62 allows the locking cleat 60 to be located in a flush orientation with the upper surface 22 of the hull 24.

Preferably, the locking cleat 60 overlaps a portion 64 of the bottom edge 48 to securely locate the bottom edge 48 within the first groove 58. A mechanical fastener 52, such as a screw, bolt, clamp, rivet or the like, is located through the locking cleat 60 and into the hull 24 such that it secures the cleat 60 and hence the bottom edge 48 securely to the hull 24. In this embodiment, the grooves 58, 62 and locking cleat 60 act to adequately support the windshield assembly 20 in a free-standing, self-supporting orientation.

Figure 6:
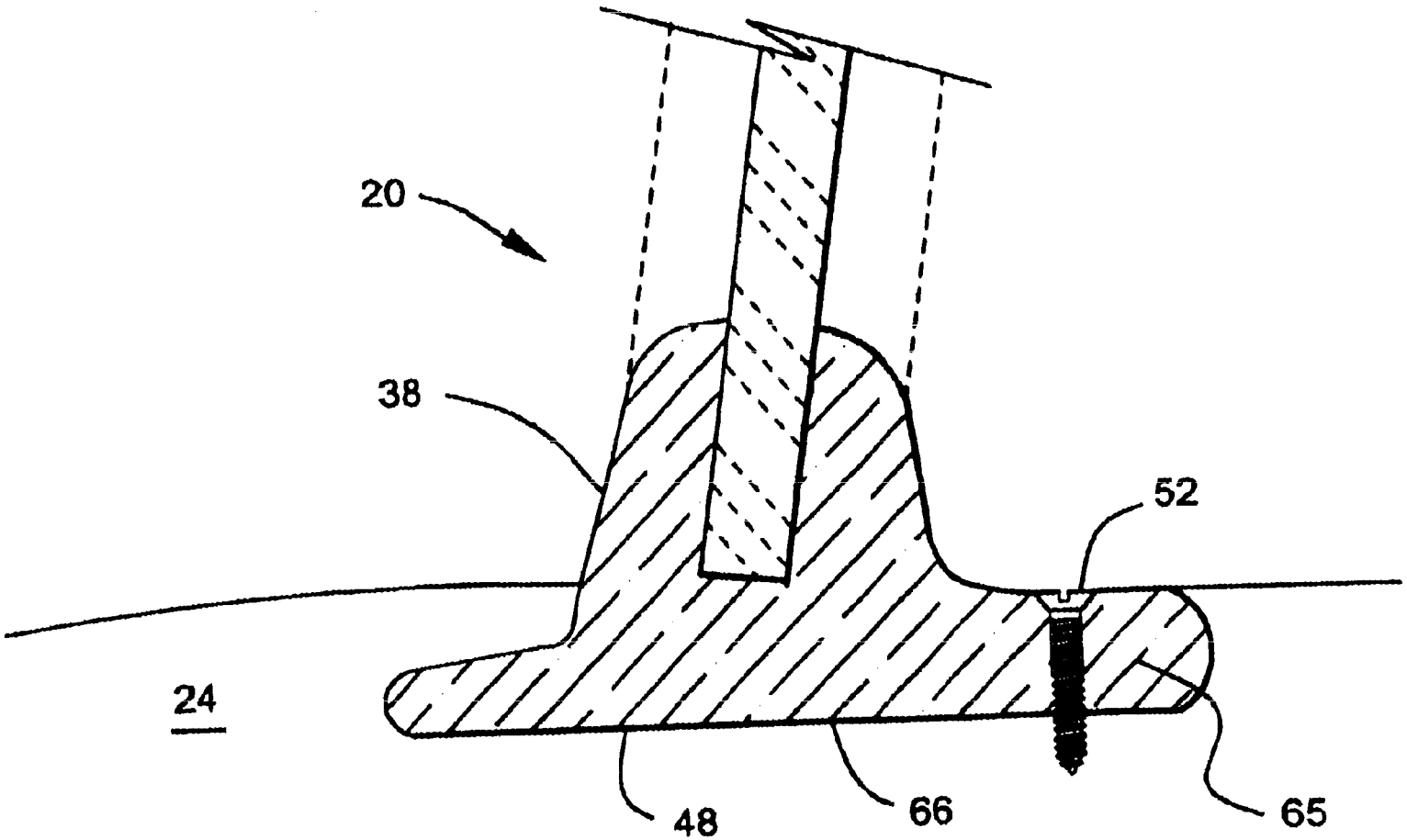
FIG. 6 is a fragmentary sectional view of yet another alternative embodiment of the present invention, taken in the direction of the arrows along section line 4—4 of FIG. 1.

FIG. 6 depicts an alternative embodiment of the present invention wherein additional polymeric material 65 is located along the bottom edge 48 of the frame 38. The bottom edge 48 is located in a groove 66 within the hull 24 designed to accommodate the additional polymeric material 65. At least one mechanical fastener 52 is located through the frame 38 and into the hull 24 to secure the windshield assembly 20 in a free-standing, self-supporting orientation.

Figure 7:
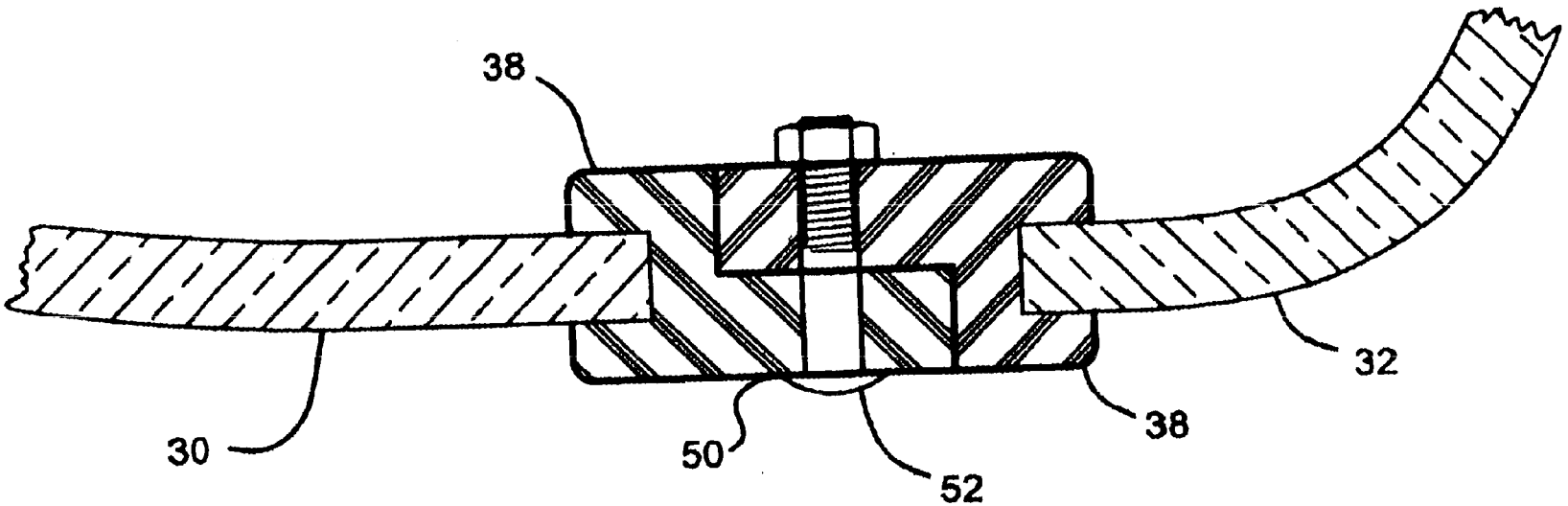
FIG. 7 is a fragmentary sectional view of the present invention, taken in the direction of the arrows along section line 7—7 of FIG. 1.
Figure 8:
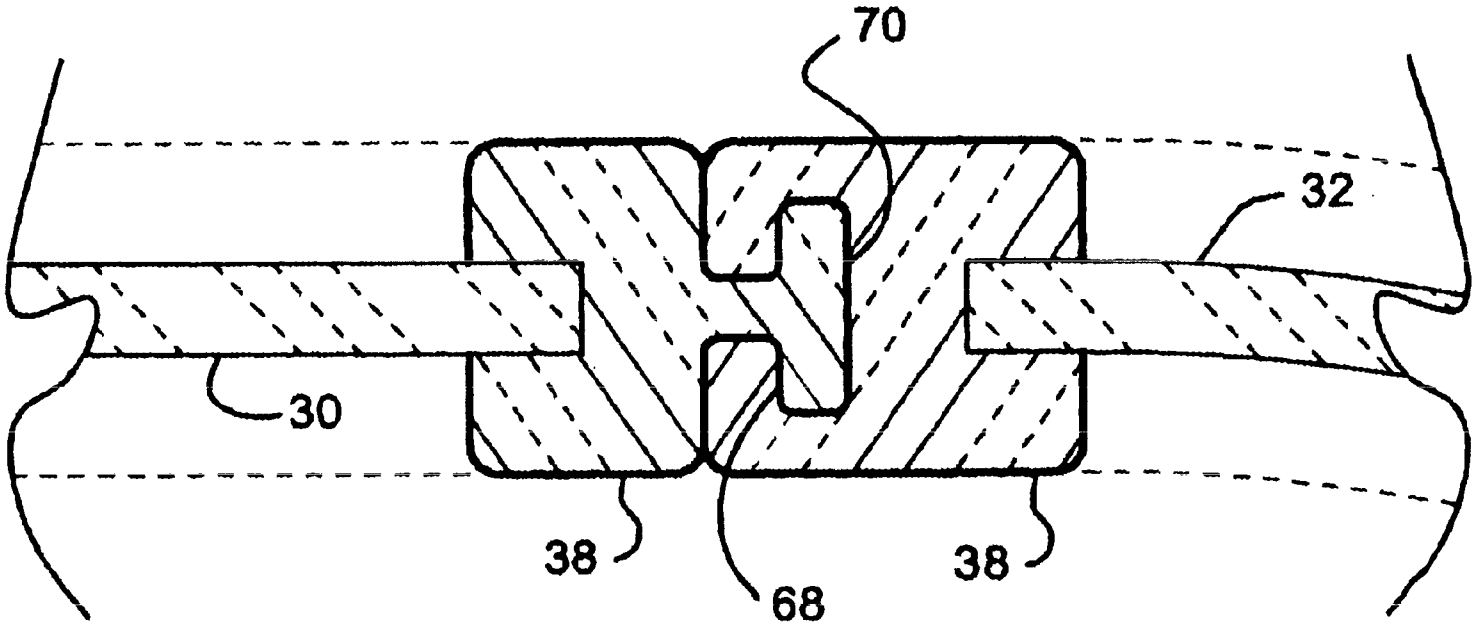
FIG. 8 is a fragmentary sectional view of an alternative embodiment of the present invention, taken in the direction of the arrows along section line 7—7 of FIG. 1.

As depicted in FIG. 1, individual framed panels 30, 32 are located adjacent each other to create a substantially continuous windshield assembly 20 for the front and sides of the hull 24. In one preferred embodiment, the framed panels 30, 32 are secured together by mechanical fasteners 52 located in the openings 50 formed in the polymeric frame 38, as depicted in FIG. 7. In an alternative embodiment, depicted in FIG. 8, framed panels 30, 32 adjacent one another may be molded so as to have complementary interlocking surfaces 68, 70, respectively, for frictional engagement with one another. The interlocking surfaces 68, 70 may be of a variety of different designs in addition to those depicted in FIG. 8 without departing from the scope or spirit of the invention. Whether the framed panels 30, 32 are located adjacent one another with mechanical fasteners 52 or interlocking surfaces 68, 70, the panels 30, 32 are located in a watertight relationship with each other.

Figure 9:
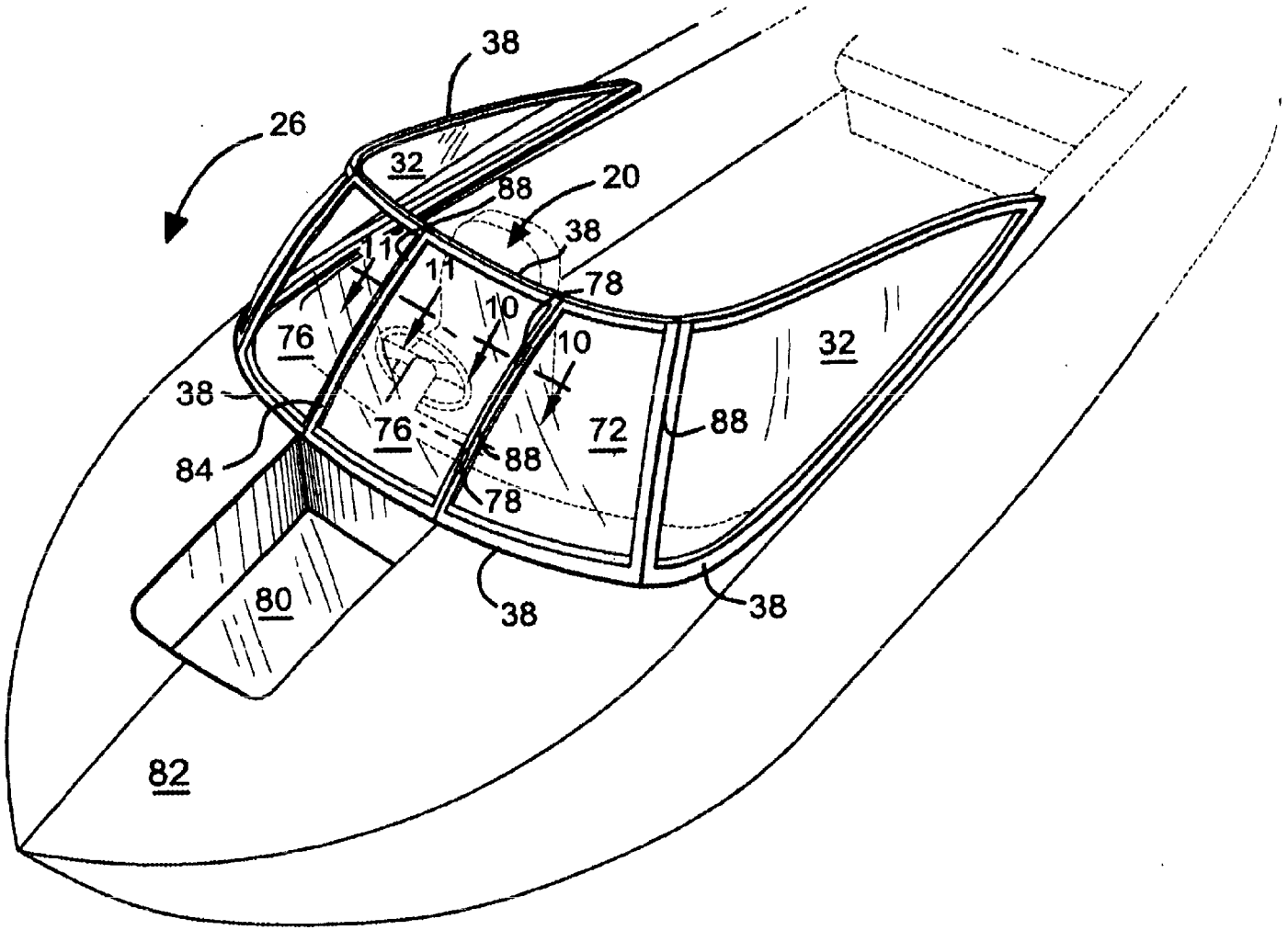
FIG. 9 is a perspective view of an alternative embodiment of the present invention.

FIG. 9 depicts a preferred alternative embodiment of the windshield assembly 20. In this embodiment, the windshield assembly 20 has at least a right 72, a middle 74 and a left 76 front transparent panel and one or more transparent side panels 32. Each panel 32, 72–76 is constructed substantially as described above including locating a frame of polymeric material 38 around the peripheral edge of each panel 32, 72–76. The framed panels 32, 72–76 are located adjacent each other to create a windshield assembly 20 having a continuous appearance.

Figure 10:
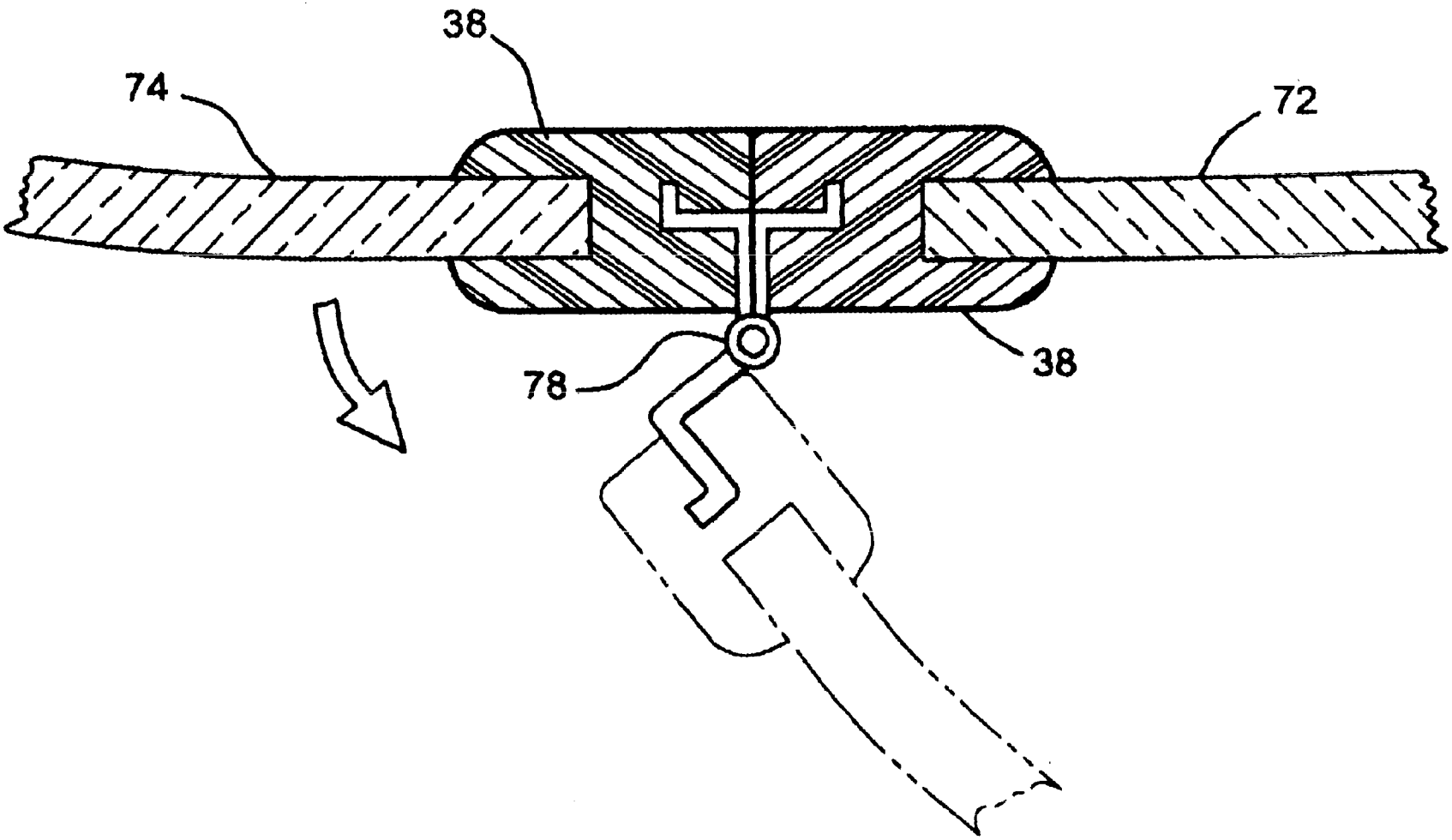
FIG. 10 is a fragmentary sectional view of the present invention, taken in the direction of the arrows along section line 10—10 of FIG. 9.
Figure 11:
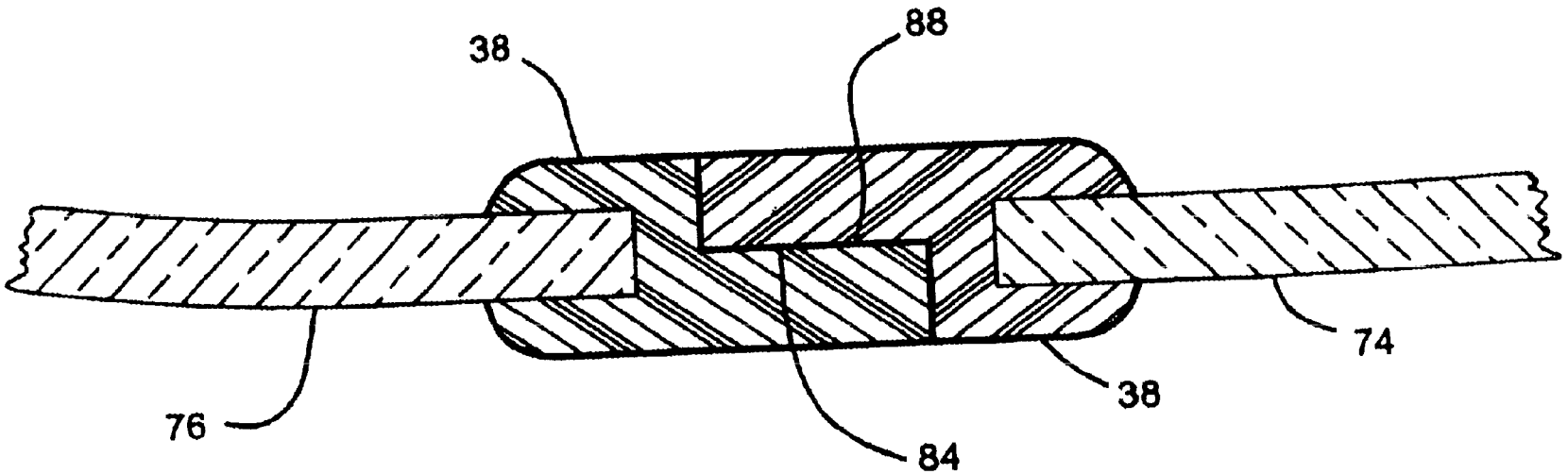
FIG. 11 is a fragmentary sectional view of the present invention, taken in the direction of the arrows along section line 11—11 of FIG. 9.

Preferably, the middle front transparent framed panel 74 is hinged 78 to an adjacent front framed panel 72 or 76 as shown in FIG. 10. The hinged front panel 74 functions as a door for access to a passenger or storage portion 80 located in the fore portion 82 of the marine vessel 26. One or more hinges 78 are preferably located within, or mechanically attached to, the polymeric material 38 molded around the middle panel 74 and the adjacent panel 72 or 76. The edge 84 opposite the hinge 78 is molded to releasably interlock, or engage, with the molded edge 84 of an adjacent panel 72 or 76 as depicted in FIG. 11. The edge 84 may also have one or more mechanical fasteners, such as previously disclosed, embedded therein for receiving a complementary fastener. Preferably, when the panels 72–76 are interlocked, a watertight seal 88 is formed between them.

Although marine windshield assemblies 20 having one 30 and three forward 72–76 facing transparent framed panels with adjacent side panels 32 have been disclosed, those skilled in the art would readily understand that the scope and spirit of the present invention includes any number of forward and side facing panels. Additionally, the present invention may be practiced with or without one of the front panels 30, 72–76 being hinged 78.

The polymeric material 38 may have color mixed therein or be painted to blend with, or complement, the overall color scheme of the marine vessel 26. The polymeric material 38, with or without paint, is highly resistant to ultraviolet radiation to resist fading and decomposition over time.

Figure 12:
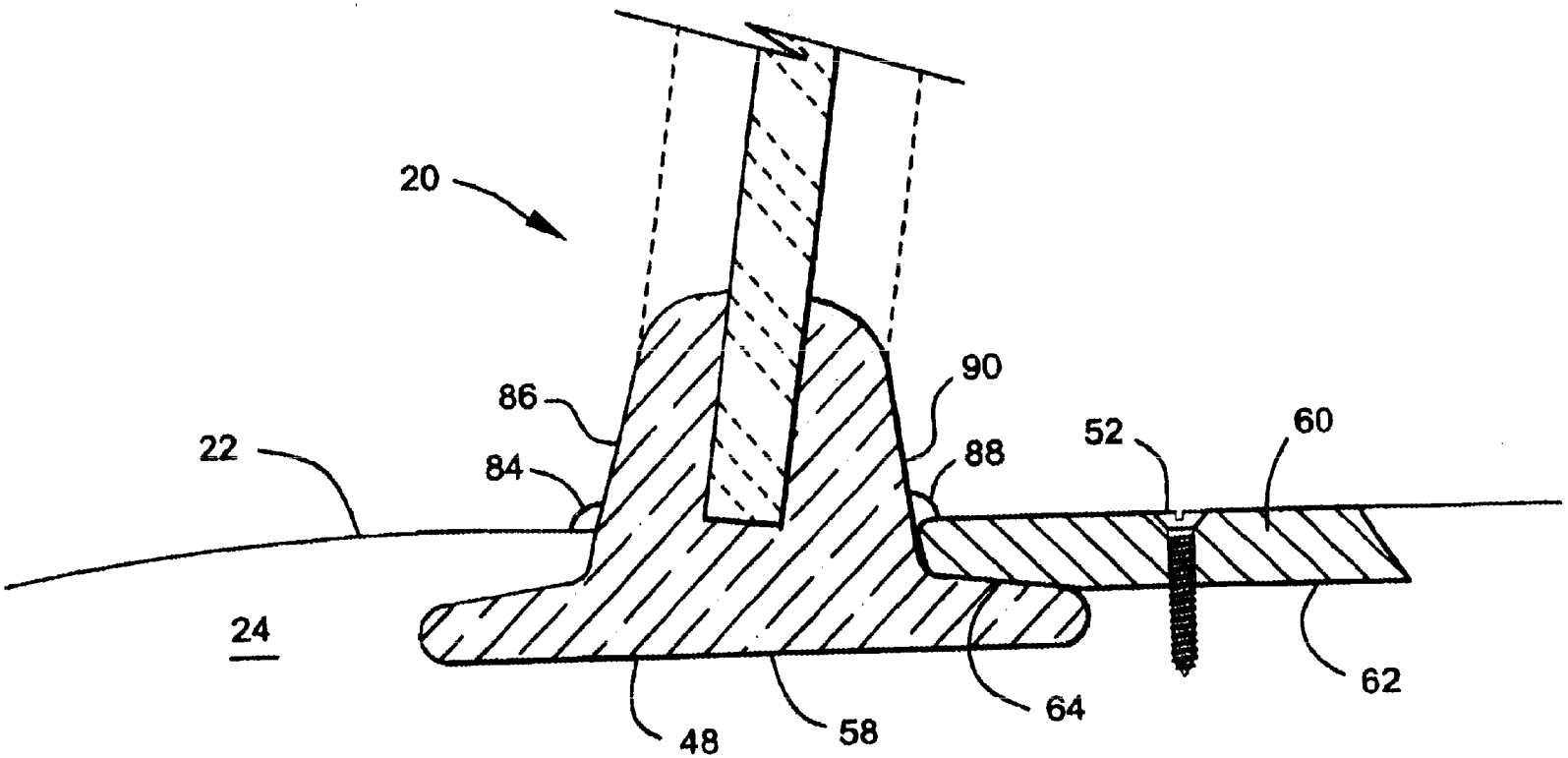
FIG. 12 is a fragmentary sectional view of an alternative embodiment of the present invention, taken in the direction of the arrows along section line 4—4 of FIG. 1.
Figure 13:
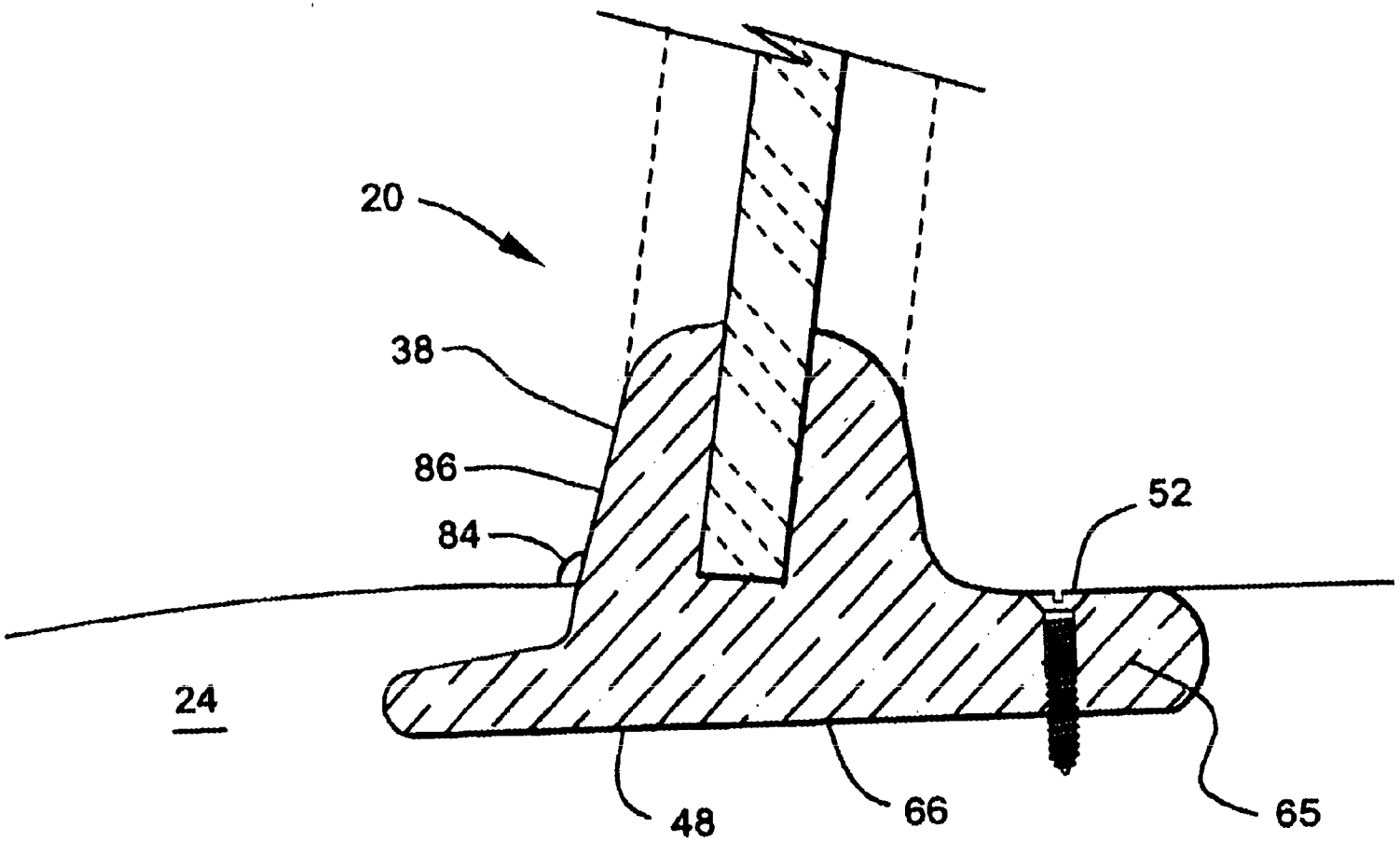
FIG. 13 is a fragmentary sectional view of an alternative embodiment of the present invention, taken in the direction of the arrows along section line 4—4 of FIG. 1.

FIGS. 12 and 13 depict an alternative embodiment of the present invention wherein one or more lips are formed from the bottom edge 48 of the polymeric frame 38. As shown in FIGS. 12 and 13, a lip 84 may be located on the leading edge 86 of the bottom edge 48. Similarly, a lip 88 may be located on a trailing edge 90 of the bottom edge 48, as shown in FIG. 12. The lips 84, 88 seal against the top surface 22 of the hull 24 and/or the locking cleat as the case may be and assist in providing a continuous appearance between the polymeric frame 38 and the hull 24 of the marine vessel 26.

Figure 14:
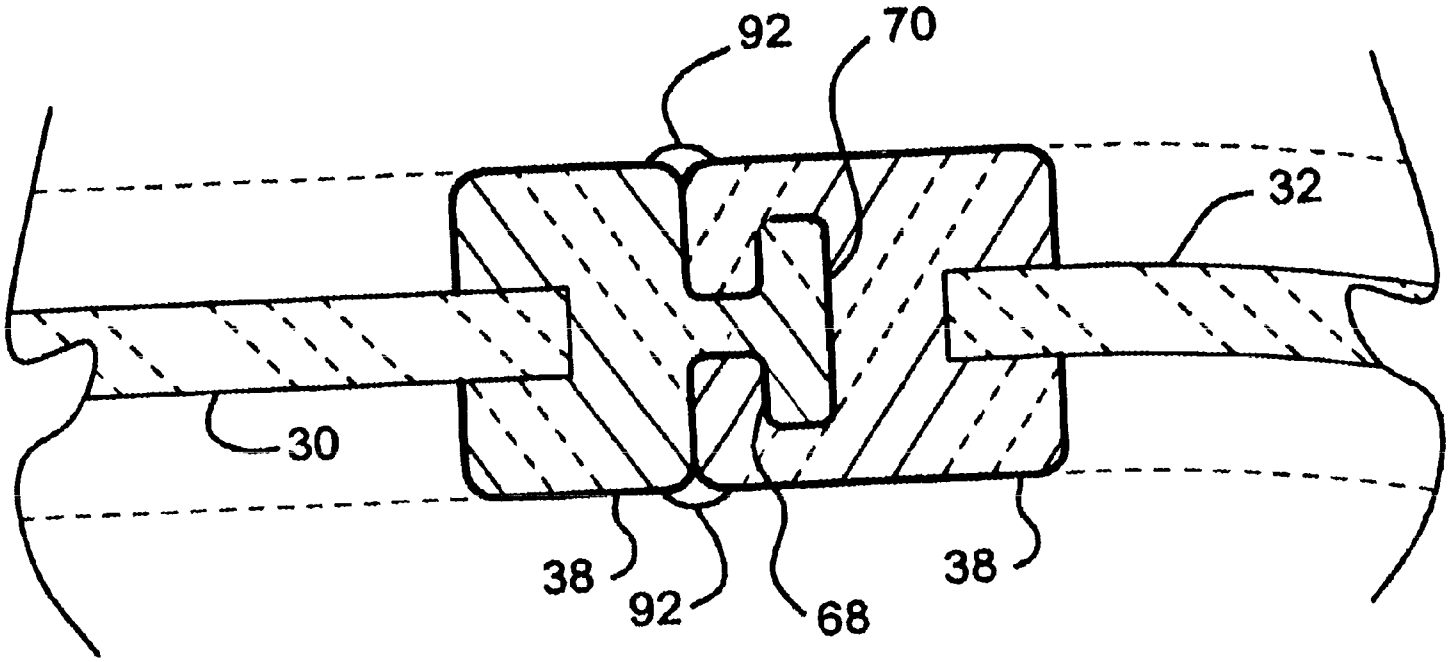
FIG. 14 is fragmentary sectional view of an alternative embodiment of the present invention taken in the direction of the arrows along section line 7—7 of FIG. 1.

One or more lips 92 may be formed from one or both of the interlocking surfaces 68, 70 as shown in FIG. 14. The lips 92 form a seal between the interlocking surfaces 68, 70 and facilitate a continuous appearance between the surfaces 68, 70.

In accordance with the provisions of the patent statutes, the present invention has been described in what is considered to represent its preferred embodiment, however, it should be noted that the invention can be practiced otherwise than as specifically illustrated and described without departing from its spirit or scope.

What is claimed is:

1. A marine vessel having a hull, said hull having an upper surface affixed to which is a free-standing assembly comprising:

a. at least one substantially transparent panel having a peripheral edge;

b. an adhesion-promoting primer applied to said peripheral edge; and c. a molded polymeric frame surrounding said peripheral edge of said at least one panel; a lower portion of said frame conforms intimately with, and is sealingly affixed to, said upper surface of said hull;

wherein said lower portion of said frame is secured within a groove located in said surface of said hull.

2. A free-standing, self-supporting windshield adapted to be secured to the hull of a marine vessel, comprising:

a. at least one sheet of a substantially transparent material having a peripheral edge;

b. an adhesion-promoting primer applied to said peripheral edge; and d. a polymeric frame located around said peripheral edge of said substantially transparent material, said polymeric frame having a lower portion adapted to conform with, and be sealingly affixed to, a surface of said hull of said marine vessel;

wherein said lower portion of said frame is secured within a groove located in said surface of said hull.

3. The windshield of claim 2, wherein said transparent material is comprised of glass.

4. The windshield of claim 2, wherein said transparent material is comprised of a plastic material.

5. The windshield of claim 4, wherein said plastic material is comprised of a polycarbonate.

6. The windshield of claim 2, wherein said polymeric frame is molded onto said peripheral edge of one or more selected portions of said substantially transparent material.

7. The windshield of claim 6, wherein said molded polymeric frame comprises a polyurethane.

8. The windshield of claim 6, wherein said molded polymeric frame comprises a polyvinyl chloride.

9. The windshield of claim 2, wherein said adhesion-promoting primer is a silane primer.

10. The windshield of claim 2, wherein a watertight seal is formed between said polymeric frame and said peripheral edge of said transparent material.

11. The windshield of claim 6, wherein openings suitable for receiving mechanical fasteners are formed in said molded polymeric frame during the molding process.

12. The windshield of claim 11, wherein rings to reinforce said openings formed in said polymeric frame are incorporated into said frame during the molding process.

13. The windshield of claim 6, wherein one or more mechanical fasteners are molded into said polymeric frame during the molding process.

14. The windshield of claim 2, wherein said lower portion of said polymeric frame is affixed to said hull in a watertight fashion.

15. The windshield of claim 14, wherein said lower portion of said polymeric frame is affixed to said hull by one or more mechanical fasteners.

16. The windshield of claim 2, wherein said lower portion of said polymeric frame is frictionally located within said groove located in said surface of said hull and affixed to said hull with one or more mechanical fasteners.

17. The windshield of claim 16, wherein said lower portion of said polymeric frame is secured to said groove by one or more locking cleats.

18. The windshield of claim 3, wherein said glass is heat-strengthened.

19. The windshield of claim 3, wherein said glass is tempered.

20. The windshield assembly of claim 2, wherein said windshield has a plurality of substantially transparent sheets, framed with polymeric material, located adjacent one another.

21. The windshield of claim 20, wherein said framed sheets are fastened to one another in a watertight fashion.

22. The windshield of claim 21, wherein said framed sheets are fastened to one another by one or more mechanical fasteners.

23. The windshield of claim 21, wherein said framed sheets have at least one edge for interlocking with an adjacent framed sheet.

24. The windshield of claim 21, wherein one of said framed sheets has one or more hinges located in said polymeric material.

25. The windshield of claim 24, wherein one of said framed sheet has one or more hinges molded in said polymeric material.

26. The windshield of claim 25, wherein said polymeric material on at least one framed sheet is molded so that at least one edge is designed to releasably interlock with an adjacent polymeric frame.

27. The windshield of claim 21, wherein said polymeric frame includes a rounded portion.

28. The windshield of claim 27, wherein said polymeric frame is capable of absorbing a physical impact.

29. The windshield of claim 2, wherein said polymeric frame continuously surrounds said peripheral edge.

30. The windshield of claim 27, wherein said rounded portion is a handrail.

31. The windshield of claim 2, wherein one or more lips are formed from said polymeric frame.

32. The windshield of claim 31, wherein said one or more lips are formed from said lower portion of said polymeric frame.

33. The windshield of claim 32, wherein said one or more lips are located on the leading edge of said lower portion of said polymeric frame.

34. The windshield of claim 32, wherein said one or more lips are located on the trailing edge of said lower portion of said polymeric frame.

35. The windshield of claim 32, wherein said one or more lips seal against said hull to provide a substantially continuous appearance.

36. The windshield of claim 26, wherein said releasably interlocking frames have located thereon one or more lips.

37. The windshield of claim 36, wherein said one or more lips seal against said interlocking frames to provide a substantially continuous appearance.

38. The windshield of claim 17, wherein said locking cleat is located in a cleat groove.

39. The windshield of claim 38, wherein said cleat groove is located adjacent said groove for said polymeric frame.

40. The windshield of claim 39, wherein said locking cleat is located in said cleat groove and flush with said upper surface of said hull.

41. The windshield of claim 40, wherein said locking cleat in said cleat groove overlaps said polymeric frame in said groove for said polymeric frame to secure said frame.

42. The windshield of claim 41, wherein one or more mechanical fasteners are located through said locking cleat in said cleat groove to secure said locking cleat.

* * * * *